United States Patent [19]

Legardinier

[11] 4,188,957

[45] Feb. 19, 1980

[54] ROD-BREAKING DEVICE FOR CIGARETTE-MAKING MACHINES

[75] Inventor: André Legardinier, Le Plessis Bouchard, France

[73] Assignee: Arenco-Decoufle, Paris, France

[21] Appl. No.: 866,223

[22] Filed: Jan. 3, 1978

[30] Foreign Application Priority Data

Feb. 3, 1977 [FR] France ..... 77 02983

[51] Int. Cl.[2] ..... A24C 1/04

[52] U.S. Cl. ..... 131/96; 83/106

[58] Field of Search ..... 131/96, 91, 84 C, 84 R; 83/106, 397, 578, 607; 200/61.62

[56] References Cited

U.S. PATENT DOCUMENTS

| | | | |
|---|---|---|---|
| 3,716,893 | 2/1973 | Vogelsang | 200/61.62 |
| 3,911,770 | 10/1975 | Boden | 83/106 |

FOREIGN PATENT DOCUMENTS

| | | | |
|---|---|---|---|
| 1389774 | 4/1975 | United Kingdom | 83/578 |

*Primary Examiner*—Robert W. Michell
*Assistant Examiner*—J. Kruter

[57] ABSTRACT

This so-called"rod-breaker" device is adapted to break and deflect the cigarette rod between the feed and the cutting machine, and comprises a cutter unit consisting of a rotatably movable blade adapted to accomplish alternating angular movements of about 90 degrees in a plane perpendicular to the rod from a position about 45 degrees to the horizontal, a fixed drying iron peen and a fixed counter-blade disposed in parallel relationship above and beneath the rod, respectively, and adjacent the movable blade for co-action therewith, and a deflector rotatably driven by the movable blade with an angular displacement causing said deflector to become operative after the breaking step.

3 Claims, 8 Drawing Figures

ROD-BREAKING DEVICE FOR CIGARETTE-MAKING MACHINES

BACKGROUND OF THE INVENTION

The present invention relates in general to cigarette-making machines and has specific reference to a rod-breaking device of the type capable of modifying the path followed by a continuous cigarette rod in a cigarette-making machine, for the dual purpose of:

on the one hand, when starting the machine, cutting the cigarette rod and introducing it into a cylindrical passage leading to the cutting machine, and on the other hand, when stopping the machine, breaking the cigarette rod and directing same downwards to prevent or stop it from feeding the cutting machine.

DESCRIPTION OF THE INVENTION

The essential feature characterizing the device of this invention lies in the fact that on the one hand the rod-breaking operation is performed automatically, thus eliminating a manual operation, and that on the other hand appreciable savings of lengths of cigarette-rod unsuited for undergoing the subsequent cigarette-making steps or operations are made, both when stopping and when starting the machine, since the automatic apparatus is adjusted for the fastest possible intervention, in contrast with a manual operation that can only take place with a certain time lag and is not always successful at the first try.

The member contemplated for performing these operations comprises a blade or cutter movable in a plane perpendicular to the cigarette rod, which co-operates with fixed drying iron peen and a fixed counter-blade disposed above and beneath the rod, respectively, and a deflector movable to an operative position with a certain time-lag after the breaking step in order to deflect or divert the cigarette rod ahead of the blades.

According to a specific form of embodiment of the present invention, the movable cutter blade is mounted on a hub rigid with the horizontal shaft of an actuator controlling a 90-degree rotation of the blade from an inoperative position in which the blade is inclined at 45° to the horizontal; the movable deflector is mounted for loose rotation on this shaft in front of the cutter blade and provided with a pair of abutment members so disposed that the deflector be carried along in either direction by the cutter blade with a certain angular displacement.

This cigarette-rod cutting mechanism is disposed between the gluing device and the cutting device, and makes it unnecessary to accompany the movement of the rod during the breaking thereof if some defect existed in the product downstream of the device.

DESCRIPTION OF THE PREFERRED EMBODIMENT

Figure 1:
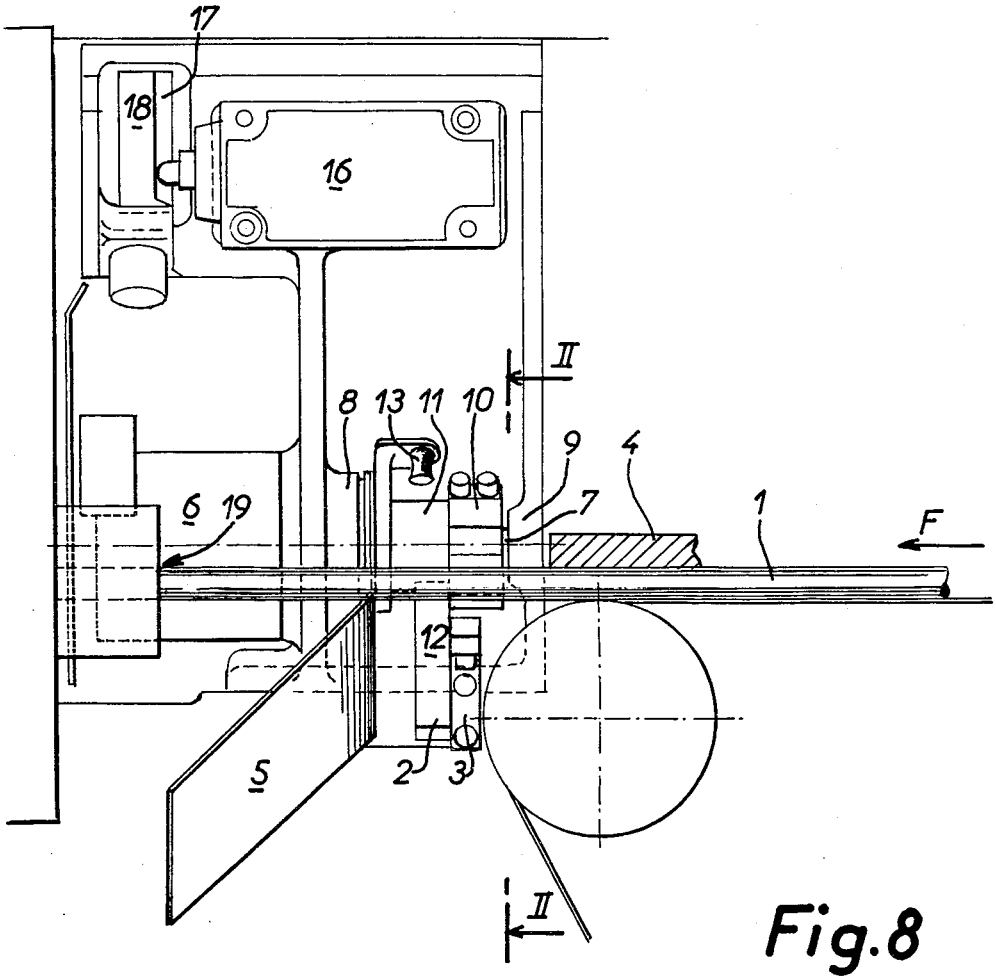
FIG. 1 is a general front elevational view of the device.

Referring firstly to FIG. 1, the assembly illustrated comprises a movable cutter blade 2 and a fixed counter-blade 3 and member 4 sometimes referred to as a drying iron peen. The counter-blade 3 and member 4 lie in a plane perpendicular to the cigarette rod 1 fed horizontally in the direction of the arrow F towards the cutter 19 between the counter-blade 3 and member 3 and 4, the movable blade 2 being retracted from the path of the cigarette rod.

The movement of the movable blade 2 is obtained by means of a rotary actuator 6 of the alternating type adapted to impart an angular curvilinear movement in either direction, from a position inclined at 45° to the horizontal, to the shaft 7 journalled in a pair of fixed bearings 8 and 9. The movable blade 2 is secured to a hub 10 rigid with shaft 7. The movable deflector 5 is secured to a support 11 pivoted freely on shaft 7. Secured to this support are a pair of abutment members 13 and 14. The upward movement of the movable blade 2 is attended, after a predetermined arcuate movement, by the upward rotation of deflector 5 via abutment member 13 carried along by the face 12 of hub of the movable blade. The purpose of this arrangement is to cause the cigarette rod 1 to be broken before the deflector 5 is in its uppermost position in which it can deflect all unusable rod sections downwards. The function of abutment member 14 is to damp out the downward stroke of support 11.

This assembly is protected by a hinged case 15 of which the open or closed position is controlled by means of an electric switch 16.

Figure 2:
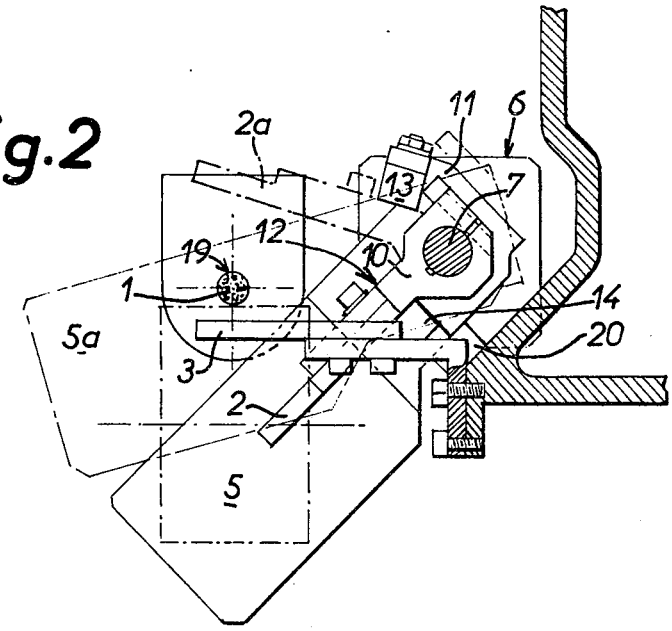
FIG. 2 is a section taken along the line II—II of FIG. 1.
Figure 3:
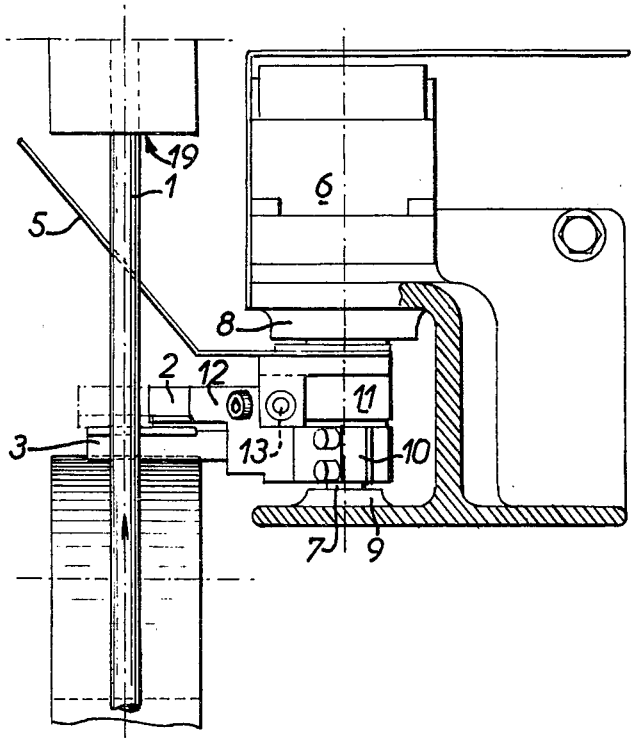
FIG. 3 is a plane view of the assembly shown in FIG. 1.
Figure 4:
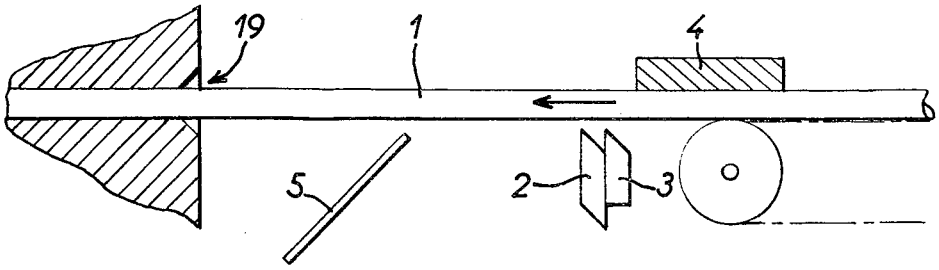
FIGS. 4, 5, 6 and 7 are explanatory diagrams concerning the mode of operation of the device.
Figure 5:
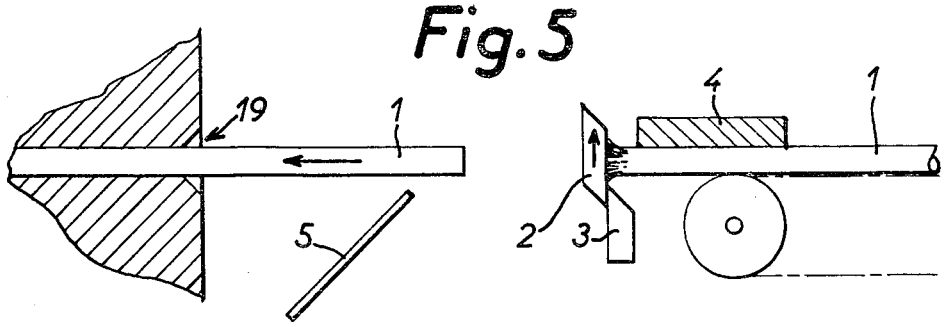

The above-described device operates as follows:

During the operation of the cigarette-making machine, the movable blade 2 is in its lower position in order to allow the passage of the maximum length of usable cigarette rod when the machine is normally at a standstill. If the machine is stopped as a consequence of a detachment of the rod, the device operates instantaneously. When the actuator 6 is operated, the movable blade 2 pivots upwardly to position 2*a* shown diagrammatically in dash and dot lines in FIG. 2. During this movement, the rod 1 is broken between the movable blade 2 and the fixed drying iron peen 4 (FIG. 5). When the movable blade 2 is raised (the machine being stopped) the rod 1 is actually broken between the movable blade 2 and the drying iron peen 4. The break is not very clean and could be really clean if a second fixed counter-blade were provided, but this is immaterial for it is only necessary that the last rod sections be ejected, due to their very high linear velocity.

Figure 6:
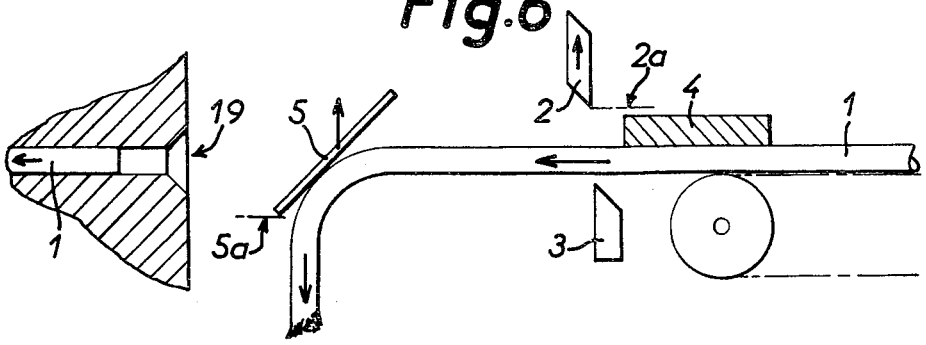

The deflector 5 carried along by the movable blade 2 through abutment member 13 is also moved upwards but begins this movement only after the rod has been broken. Thus, the position shown at 5*a* in FIG. 6 is attained by this deflector, for engagement by the rod 1.

Conversely, when starting the machine, the cigarette rod not completely closed by the gluing operation is deflected downwards by deflector 5 still in position 5*a*. Adjustable time-lag means are provided for starting the rod-cutting movement exactly when the glued and usable rod is perpendicular to blade 2.

Figure 7:
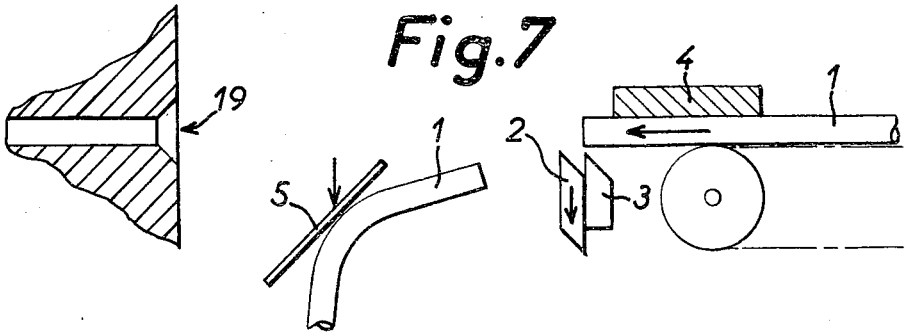

When triggered, the movable blade 2 is rotatably driven in the downward direction and cuts the rod 1 against the fixed counter blade 3. The movement of blade 2 releases the deflector 5 movable about the axis of shaft 7, and deflector 5 drops back thus clearing the passage for the cigarette rod which, being properly cut, continues its path and penetrates into the orifice 19 leading to the cutting machine (FIG. 7).

Figure 8:
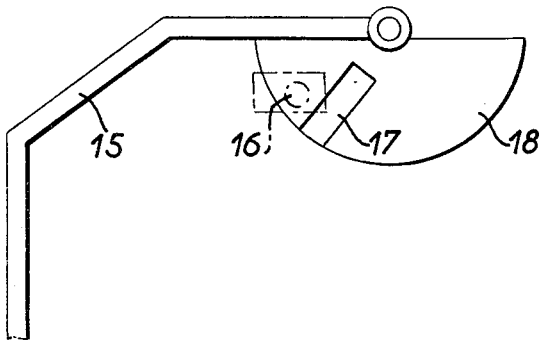
FIG. 8 is a detail view.

To safely prevent any hazard, the closed or open position of the hinged protection case 15 is controlled by means of an electric switch 16 responsive to a cam face 17 formed in a segment 18 rigid with case 15. The cam face 17 is so positioned that switch 16 is actuated from the very beginning of the rotational movement of segment 18 (see FIG. 8).

If the case 15 were opened during the machine operation, the low position of blade 2 would be maintained but the device could not operate as long as the case 15 remains open.

Switch 16 restores immediately the operation of the device when the case 15 is closed, due to the provision of the cam face 17.

It will readily occur to those conversant with the art that various modifications and changes may be brought to the specific form of embodiment illustrated and described herein without departing from the basic principles of the invention as set forth in the appended claims.

What is claimed as new is:

1. A device for breaking and deflecting a cigarette-rod between the cigarette making section and the cutting section of a cigarette-making machine comprising a cutting blade rotatably movable in a plane perpendicular to the rod about a fixed horizontal axis parallel to that of the rod through an angle of about 90° between two end positions, one end position being a normal position during operation of the machine, in which the blade is below the cigarette-rod, and the other end position being attained upon stopping of the machine, in which the blade is above said rod after having broken it, a fixed counter-cutter blade disposed below the rod, recessed with respect to said movable cutting blade, and a bearing piece, such as a drying iron peen, above the cigarette rod recessed with respect to the fixed counter-blade, both cooperating with the movable cutting blade to break the cigarette rod during the rising movement of the cutting blade and to cut it during its descending movement, a deflector flap rotatable about the same axis as the movable cutting blade normally disposed below the cigarette rod to permit the latter to freely pass towards the cutting section and rotated upwardly by the movable blade with an angular lag determining its coming into operation only after breaking the cigarette rod for deflecting the cigarette rod and preventing it from reaching the cutting section, and means for controlling the upward and downward rotation of the cutting blade and the deflector.

2. A device as claimed in claim 1, wherein stops limit the rotary movements of the movable cutting blade.

3. A device as claimed in claim 1, wherein the means for controlling the rotary movement of the movable cutting blade consist of an actuator coaxially mounted therewith.

* * * * *